US010098406B2

(12) United States Patent
Erb et al.

(10) Patent No.: US 10,098,406 B2
(45) **Date of Patent: *Oct. 16, 2018**

(54) FOOTBALL HELMET WITH FACEGUARD HAVING RAISED EYEBROW AREAS

(71) Applicant: KRANOS IP CORPORATION, Litchfield, IL (US)

(72) Inventors: Robert Erb, Plandome, NY (US); Cortney Warmouth, Edwardsville, IL (US); Vincent R. Long, St. Peters, MO (US); Louis Anthony Vanhoutin, Luka, IL (US)

(73) Assignee: Kranos IP Corporation, Litchfield, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/799,335

(22) Filed: Oct. 31, 2017

(65) Prior Publication Data

US 2018/0055133 A1 Mar. 1, 2018

Related U.S. Application Data

(63) Continuation of application No. 14/815,491, filed on Jul. 31, 2015, now Pat. No. 9,833,033, which is a (Continued)

(51) Int. Cl.
*A42B 3/20* (2006.01)
*A42B 3/12* (2006.01)

(52) U.S. Cl.
CPC ..... *A42B 3/20* (2013.01); *A42B 3/124* (2013.01); *A42B 3/125* (2013.01); *A42B 3/127* (2013.01); *A42B 3/128* (2013.01)

(58) Field of Classification Search
CPC ..... A42B 3/20; A42B 3/124; A42B 3/125; A42B 3/127; A42B 3/128
See application file for complete search history.

(56) References Cited

U.S. PATENT DOCUMENTS 287,331 A * 10/1883 Schaap ..... A42B 3/20 2/9
2,715,222 A * 8/1955 Sowle ..... A63B 71/10 2/424

(Continued)

FOREIGN PATENT DOCUMENTS

GB 2535639 A 8/2016

*Primary Examiner* — Richale Quinn
(74) *Attorney, Agent, or Firm* — Notaro, Michalos & Zaccaria P.C.

(57) ABSTRACT

A football helmet comprising a rigid plastic shell adapted to cover the head of a wearer and a faceguard in the form of a cage of metal bars and removably attached to the shell. The faceguard includes an upper portion including an uppermost bar having a center bar part and a pair of side bar parts, and a horizontal bar below the center bar part and connected to the center bar part by a vertical bar, the uppermost bar and horizontal bar defining a gap between them which extends the entire length of the horizontal bar. The faceguard has a pair of raised eyebrow areas, each raised eyebrow area consisting of one of the pair of side bar parts bent upwardly with respect to the center bar part, in the uppermost bar being positioned on either side of the front portion of the shell and above the lower edge of the front portion of the shell.

12 Claims, 10 Drawing Sheets

Related U.S. Application Data continuation of application No. 13/526,077, filed on Jun. 18, 2012, now Pat. No. 9,131,744.

(56) References Cited

U.S. PATENT DOCUMENTS 3,039,109 A 6/1962 Simpson
3,086,899 A 4/1963 Smith
3,139,624 A * 7/1964 Humphrey ..... A42B 3/20 2/9
3,153,792 A 10/1964 Marietta
3,373,443 A 3/1968 Marietta
3,609,764 A 10/1971 Morgan
3,713,640 A 1/1973 Margan
3,761,959 A 10/1973 Dunning
3,843,970 A 10/1974 Marietta
4,031,564 A * 6/1977 Wood ..... A42B 3/20 2/9
4,239,106 A 12/1980 Aileo
4,287,613 A 9/1981 Schulz
4,345,338 A 8/1982 Frieder
D267,287 S 12/1982 Gooding
4,432,099 A 2/1984 Grick
4,558,470 A 12/1985 Mitchell
4,586,200 A 5/1986 Poon
5,263,203 A 11/1993 Kraemer
5,390,367 A * 2/1995 Rush, III ..... A41D 13/018 2/413
5,518,802 A 5/1996 Colvin
5,661,849 A * 9/1997 Hicks ..... A42B 3/20 2/424
5,787,513 A 8/1998 Sharmat
5,953,761 A 8/1999 Jurga
6,102,424 A * 8/2000 Cole, Jr. ..... B60D 1/60 150/166
6,131,196 A 10/2000 Vallion
6,189,156 B1 * 2/2001 Loiars ..... A42B 3/20 2/424
6,272,692 B1 8/2001 Abraham
6,301,719 B1 * 10/2001 Goodhand ..... A42B 3/20 2/422
D590,106 S * 4/2009 Nimmons ..... D29/122
7,673,351 B2 3/2010 Copeland
8,069,498 B2 12/2011 Maddux
8,176,574 B2 5/2012 Bryant
8,201,269 B2 6/2012 Maddux
8,209,784 B2 * 7/2012 Nimmons ..... A42B 3/20 2/411
8,544,117 B2 10/2013 Erb
8,572,767 B2 11/2013 Bryant
8,726,424 B2 5/2014 Thomas
8,813,269 B2 8/2014 Bologna
2004/0025231 A1 * 2/2004 Ide ..... A42B 3/08 2/425
2009/0044316 A1 * 2/2009 Udelhofen ..... A42B 3/20 2/424
2009/0083900 A1 * 4/2009 Wallace ..... A42B 3/20 2/424
2010/0299812 A1 12/2010 Maddux
2013/0014313 A1 10/2013 Erb
2013/0312165 A1 * 11/2013 Hardy ..... A42B 3/20 2/424
2014/0150168 A1 * 6/2014 Erb ..... A42B 3/08 2/421
2014/0187875 A1 * 7/2014 Paris ..... A61B 5/6803 600/301
2014/0223646 A1 * 8/2014 Bologna ..... A42B 3/20 2/424
2014/0325745 A1 11/2014 Erb
2015/0033457 A1 * 2/2015 Tryner ..... A42B 3/205 2/421
2015/0230537 A1 8/2015 Warmouth
2015/0335092 A1 11/2015 Erb

* cited by examiner

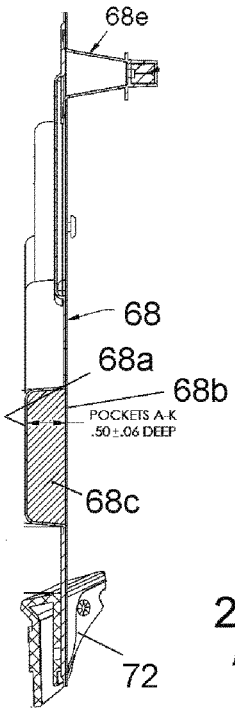
FIG. 22
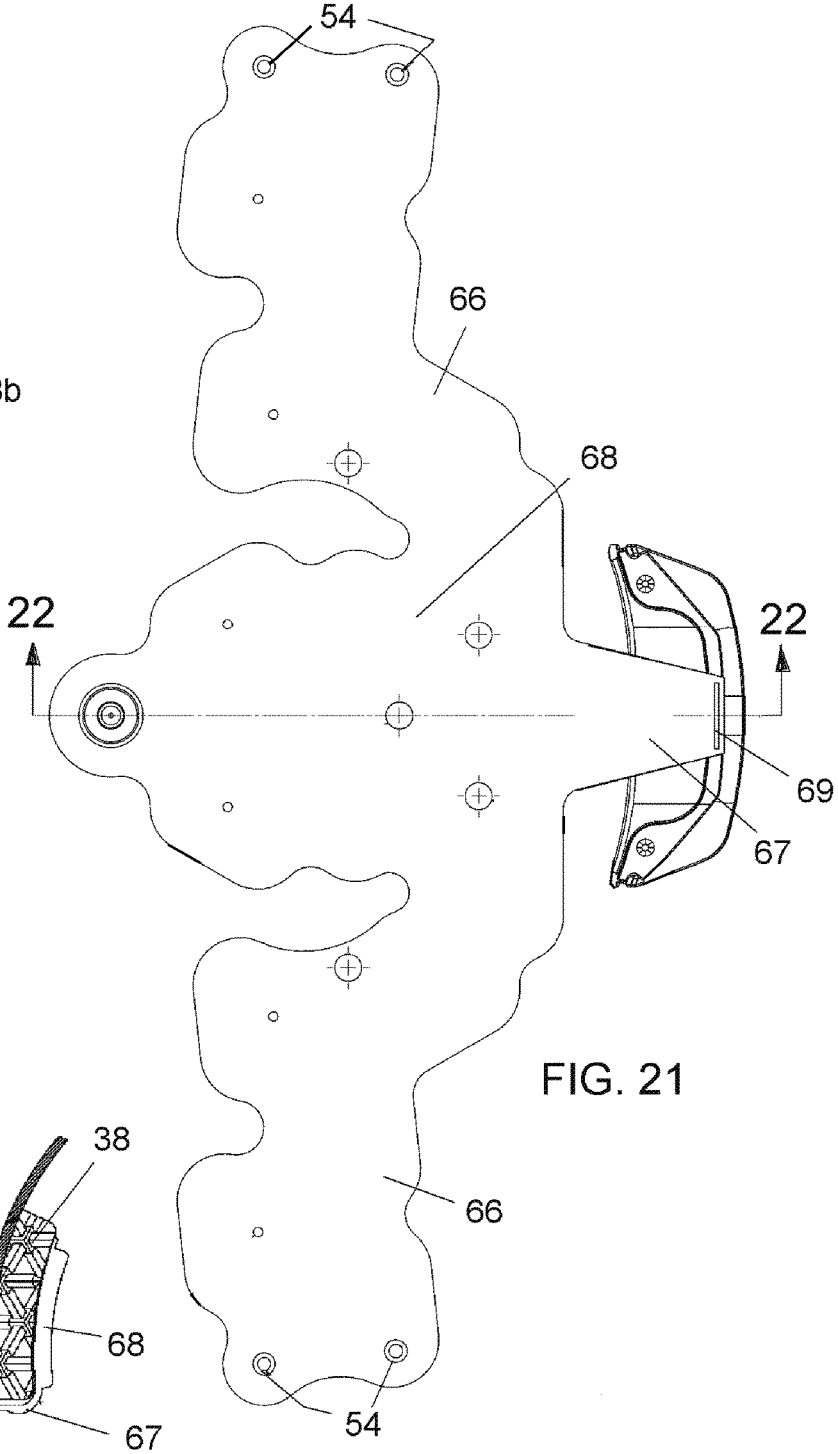
FIG. 21
FIG. 23
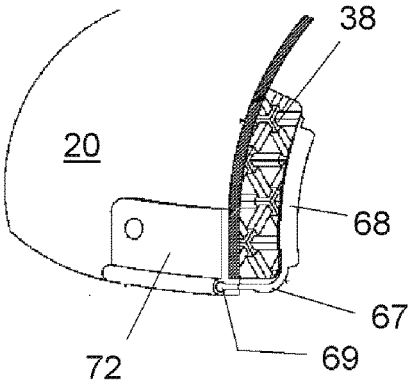

FOOTBALL HELMET WITH FACEGUARD HAVING RAISED EYEBROW AREAS

CROSS-REFERENCE TO RELATED APPLICATION

This application is a continuation of U.S. patent application Ser. No. 14/815,491, filed Jul. 31, 2015, now U.S. Pat. No. 9,833,033, which is a continuation of U.S. patent application Ser. No. 13/526,077, filed Jun. 18, 2012, now U.S. Pat. No. 9,131,744.

FIELD AND BACKGROUND OF THE INVENTION

The present invention relates generally to the field of protective helmets, and in particular to a new and useful football helmet.

U.S. Pat. No. 8,069,498 to Maddux et al. discloses a helmet with a rigid shell containing impact absorbing pads that are removably attached to the inner surface of the shell. The pads are made of spaced inner and outer sheets of TPU (thermoplastic urethane) each have a plurality of spaced apart and projecting hollow protrusions extending to the other sheet with the protrusions of one sheet alternating with the protrusions of the other sheet to form an impact absorbing pattern of alternating protrusions in the space between the sheets. From this reference it is known to use hook-and-loop fastening tape for connect the pads to the inner surface of the helmet shell.

U.S. Pat. No. 8,146,178 to Maddux et al. discloses a quick release, twist-off faceguard retainer for use with a protective headgear and faceguard. The headgear has a face opening and the faceguard has at least one substantially horizontal top bar. The retainer includes two complementary retention arms that form two complementary retention channels with one channel having a downward opening and the other having an upward opening. Each have an inner surface which together surround the top horizontal bar of the faceguard. A space between the two retention arms receives the top bar so that the faceguard can be twisted into place.

Published U.S. patent application US 2009/0106882 to Nimmons et al. discloses a helmet with unique shell configuration and faceguard assembly with unique attachments at the sides of the helmet shell for connecting the faceguard to the shell. As with conventional faceguards, the faceguard of this patent application has upper cross-bars that extend generally horizontally across the front of the helmet shell, just above the lower edge of the face opening of the shell.

Published U.S. patent application US 2011/0131695 to Maddux et al. discloses a protective jaw pad for a helmet shell that includes first and second resilient shock absorbing members. The first shock absorbing member includes a sheet with a plurality of hollow protrusions, tapering side walls of the protrusions being compressible for absorbing shocks applied to the shell and the second resilient shock absorbing member is either a monolithic block of foam or is made of a second sheet with a plurality of hollow protrusions that are interleaved with the first protrusion.

Published U.S. patent application US 2011/0214224 to Maddux et al. discloses a helmet with partial turn faceguard mounting for faceguard connecting loopstraps that engage around wire or bar segments of the faceguard to fasten the faceguard to the helmet shell.

A need remains for further advancements in the field of football helmet design.

SUMMARY OF THE INVENTION

It is an object of the present invention to provide a football helmet with helmet shell, faceguard, internal padding system, comfort liner, attachment arrangement and other improvements over currently known helmets.

Accordingly one of the various objects of the invention is to provide a football helmet with replaceable nose bumpers. One of the nose bumpers is of the twist-off faceguard retainer type for the quick removal of a faceguard according to U.S. Pat. No. 8,146,178 and the other is a nameplate nose bumper that can accommodate an eye shield and/or multiple loopstraps for connecting a faceguard to the helmet shell. U.S. Pat. No. 8,146,178 is incorporated herein by reference for its teaching of a twist-off faceguard retainer.

The retainer and the nameplate holder of the nose bumper are each molded pieces, one serving as a nameplate holding bumper and the other as a twist-off retainer. Both are capable of mounting the upper portions of a faceguard to a helmet shell.

Both retainer and holder are provided in the improved helmet because the twist-off retainer alone does not allow the user to mount most currently available eye shields or certain faceguards to the helmet. Also, not all users desire the twist-off feature since it is so new and different. For these reasons and to satisfy user demand and provide flexibility to mount all of the following, both the twist-off retainer and the nameplate holder are included in one new helmet. The new helmet can accommodate: traditional loopstraps and hardware; quarter turn loop straps and hardware such as those of published U.S. patent application US 2011/0214224; and all manufacturers' eye shields. Published patent application US 2011/0214224 is incorporated herein by references for its teaching of partial turn fasteners for mounting loopstraps for faceguards to a helmet shell.

This two piece design of a nameplate holder with a twist-off retainer mounted over the top of the holder allows product to be sent out that addresses all user requests and combinations. If a user wants to use the twist-off feature and has no eye shield then they just use the product as shipped. If user has an eye shield or desires to use other mounting hardware in place of the twist-off retainer than they simply unscrew two screws and remove the twist-off retainer and then are left with the molded nameplate holder that allows the mounting of other hardware such as loopstraps and eye shields.

Another object of the invention is to provide a helmet that includes an improved comfort liner assembly that has areas of foam cushioning of different hardness for improving comfort and also for improving the impact absorbing qualities of the new helmet. A triangular modular cushion arrangement is also provided for the back, sides and crown of the comfort liner.

The improved helmet also includes a new mounting arrangement for the improved comfort liner that makes the initial assembly and all later reconditioning of the helmet easier and more secure then using hook-and-loop fasteners that has been the preferred mounting mechanism for both the comfort liner and the padding, up until now.

The comfort liner assembly has three separate comfort liners that make up the assembly set for the helmet. These are a front liner, a crown liner, and a lateral liner. The crown liner and the lateral liner are air liners that utilize air to fit the helmet to the wearer. The front liner is unique because it utilizes a new way of attaching the liner to the nose bumper and helmet shell. To this end the front liner incorporates a molded nose bumper that has a tongue and groove design that allows it to easily slide into and attach to the injection molded guard mount or nameplate holder that is ultimately attached to the helmet shell. This design eliminates the need for wrapping the liner around the front pad and using adhesive tape for liner attachment which was the method of the past. By getting rid of tape, the liner is easier to assemble, more robust and less susceptible to potential failures in the field, and by eliminating the thickness of hook-and-look (e.g. Velcro brand) tape fasteners the inventors are able to increase the standoff or thickness of the TPU padding system which has lead to a significant improvement in performance of the helmet.

Also, the front comfort liner includes both softer foam (e.g. VN1000 polyether polyurethane foam) and harder foam (e.g. PORON foam) in three critical front pockets of the front liner. This harder foam in place of the softer, comfort-only foam, has also lead to a significant performance improvement. Two of the pockets in the front liner still contain the traditional softer comfort foam members. The front comfort liner also includes a button and elastic straps that allow it to be attached to the TPU padding easily and without adhesive and hook-and-loop fastening tapes. This attachment system (button and elastic strapping) is unique and improves ease of assembly while providing less chance of detachment in the field.

The crown liner and the lateral liner both are unique in that they too incorporate the buttons on their outer, shell-facing surfaces, that slide into selectively placed keyholes in the inner surfaces of TPU pads of the helmet's padding system, and thus hold the liners in place.

Another object of the invention is to provide a football helmet with dual durometer TPU padding in selected areas of the helmet shell that also improve the impact attenuating characteristics of the helmet. A single durometer TPU padding of a similar structure is disclosed in U.S. Pat. No. 8,069,498 in the sense that it comprises pads with inner and outer parts of molded thermoplastic urethane, each including a sheet with a plurality of spaced alternating hollow protrusions extend to the other sheet, but for the improved helmet disclosed herein, the outer part is of softer or lower durometer than the inner part for some of the pads. This is not the case for U.S. Pat. No. 8,069,498 which uses equal durometer inner and outer TPU padding parts. Other areas of the new helmet have higher and substantially equal durometer values for the inner and outer parts of their pads. U.S. Pat. No. 8,069,498 is incorporated herein by reference for its teaching of TPU pad construction.

The opposing pieces of TPU with integrated cones or protrusions that oppose each and have different durometer, allow the padding to absorb both smaller and larger impacts while maintaining the most comfort for the wearer. The TPU cones of the outer parts of the pads, coming from the vicinity of the helmet shell ans extending toward the wearer's head, are wider at the shell and narrow down as they come toward the head of the wearer and are of a softer durometer for at least some of the pads to provide the most comfort for the wearer. In these pads, the inner part cones with larger surface protruding from the vicinity of the wearers head, and narrowing toward the shell, are of a stiffer durometer.

A still further object of the invention is to provide a football helmet with padding that is fastened to the inside surface of the shell using mechanical fasteners that extend through the shell, preferably in the form of T-nuts or similar mechanical fasteners at strategic locations in the helmet shell, rather than the currently used hook-and-loop tapes for this purposed. This greatly improves ease of assembly of the padding system in the helmet shell initially, and expedites replacing the padding system that is done as part of the reconditioning of a football helmet, for example, before the start of each new football season.

Another object of the invention is to provide a football helmet with a unique faceguard having an upper bar assembly with raised eyebrow areas at the sides that extend by multiple times the diameter of the bars over the front portions of the helmet shell, above a lower edge of the front portion of the shell that forms a face opening, and on either side of the nose bumper. This adds further protection to the player wearing the helmet by separating any impact with the faceguard even further from the helmet shell then is the case for prior faceguards.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 21 is an outer surface view of a lateral liner of the comfort liner assembly;

FIG. 22 is a sectional view taken along line 22-22 of FIG. 21, of the lateral liner; and FIG. 23 is a detail view of the connection between the lateral liner and a back bumper of the helmet.

DESCRIPTION OF THE PREFERRED EMBODIMENTS

Figure 1:
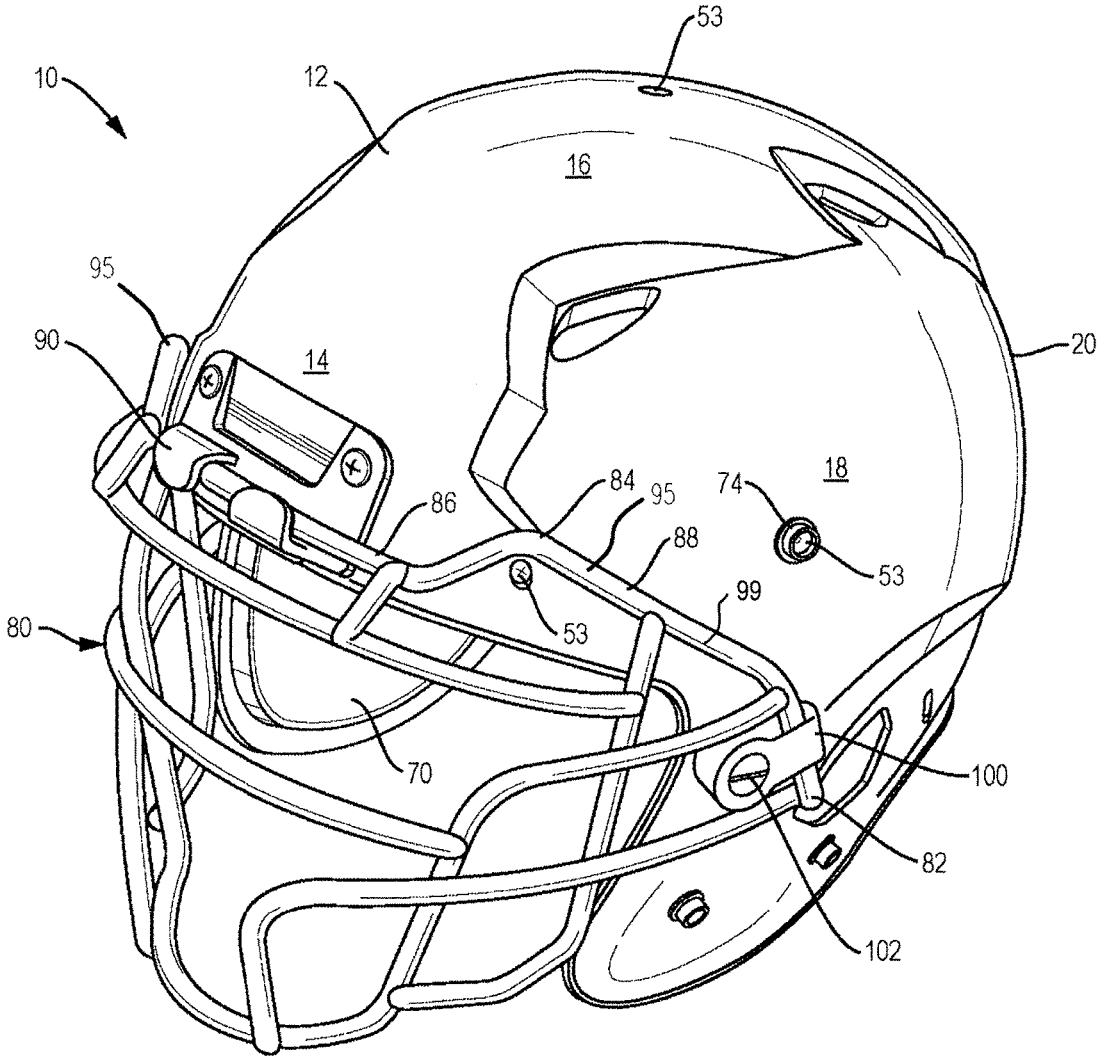
FIG. 1 is a perspective view of a football helmet according to the present invention.
Figure 2:
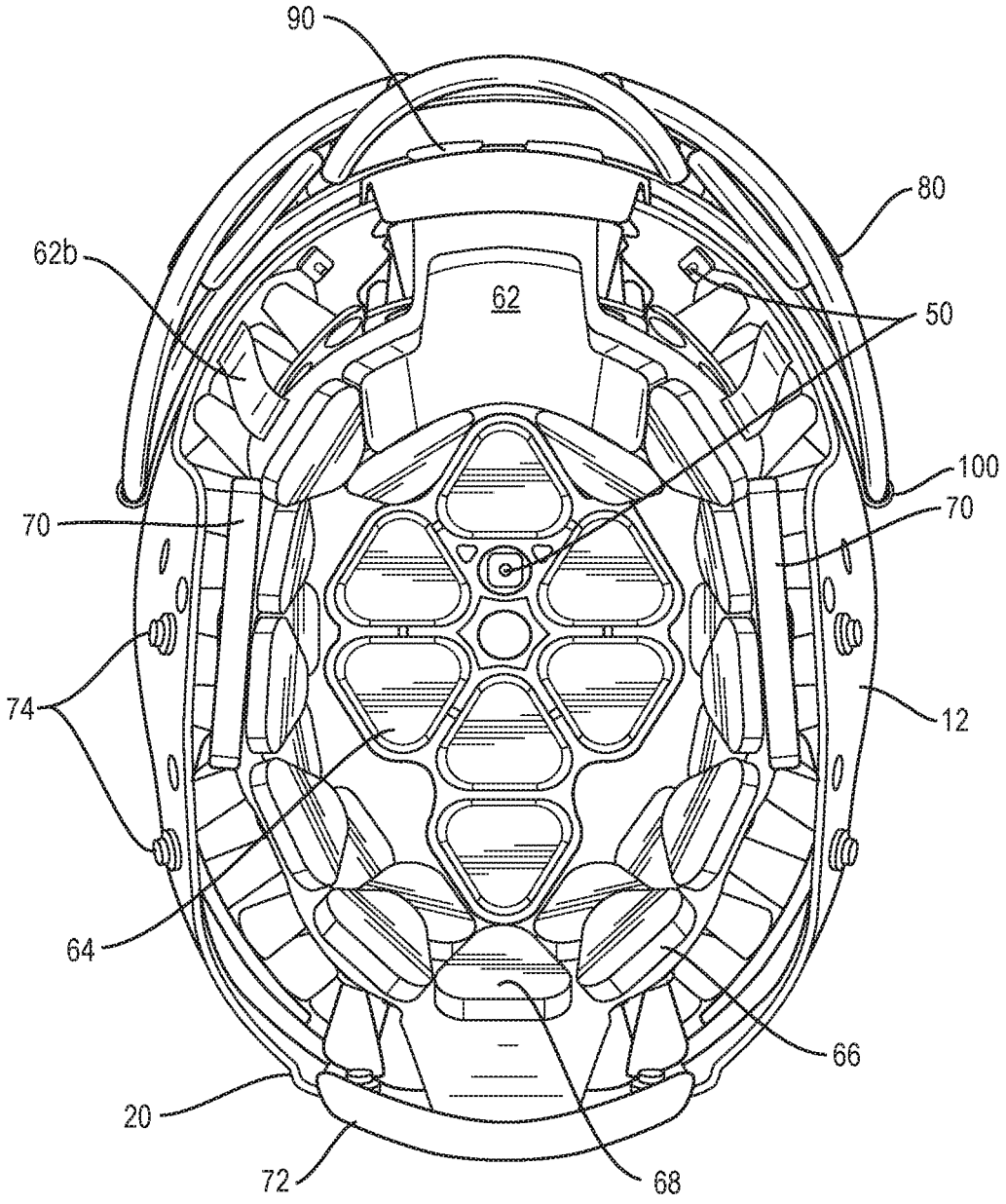
FIG. 2 is a bottom plan view of the helmet.
Figure 3:
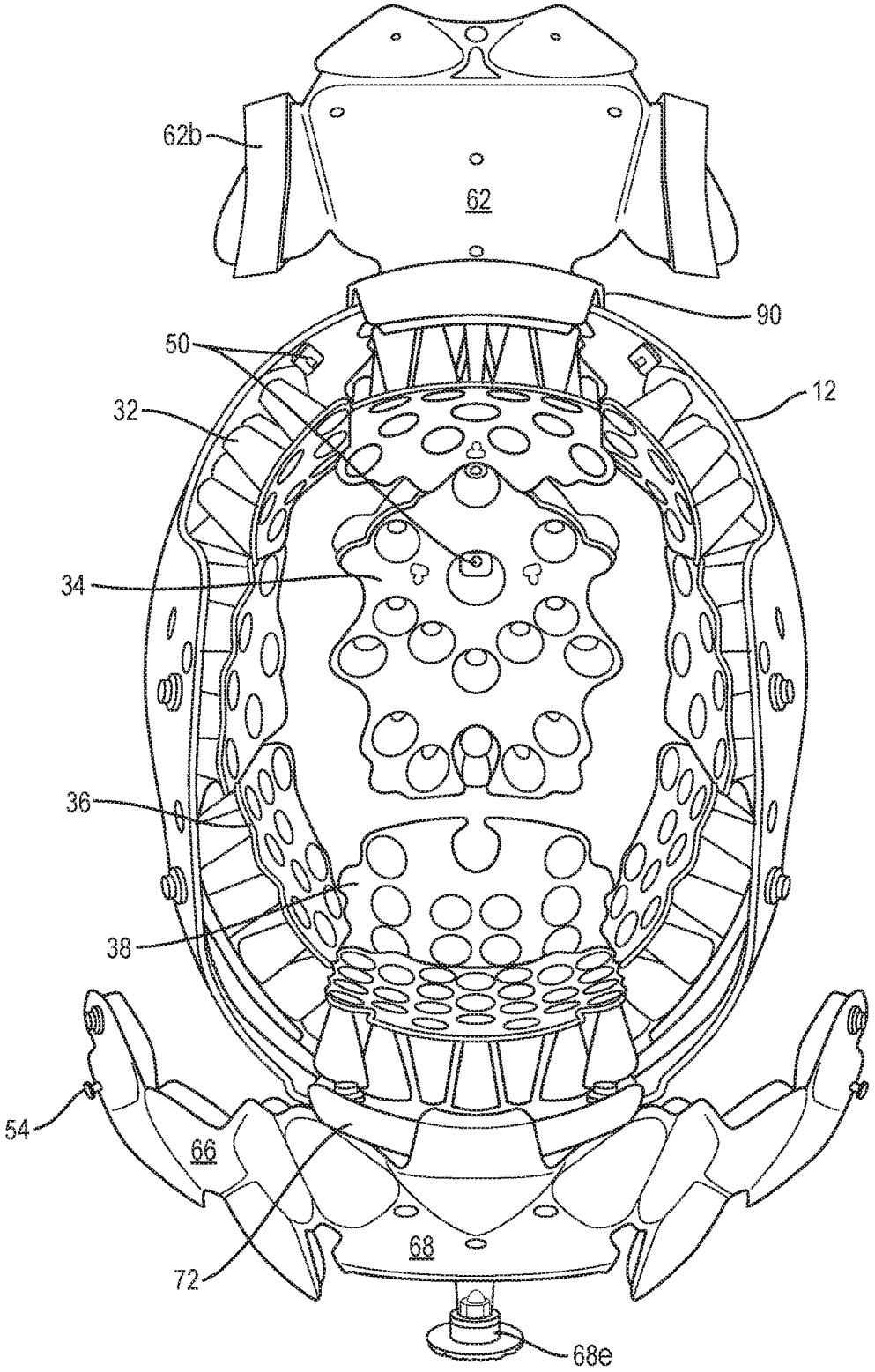
FIG. 3 is a view similar to FIG. 2, but with a comfort liner assembly pealed away to reveal a padding system of the helmet.

Referring now to the drawings, in which like reference numerals are used to refer to the same or similar elements, FIG. 1 shows a football helmet 10 comprising a rigid shell 12 adapted to cover the head of a wearer, the rigid shell having an outer surface and an inner surface, the inner surface having selected concave curvatures at various portions of the shell as can be better appreciated from FIGS. 2 and 3. Returning to FIG. 1, the shell 12 has a front portion 14 for covering the forehead of the wearer, a crown portion 16 for cover the top of the wearer's head, a pair of opposite side portions 18 for covering the sides of the wearer's head, and a back portion 20 for covering the back of the wearer's head.

As shown in FIGS. 3, 4 and 6-10, a padding system is removably attached to the inner surface of the rigid shell 12 and comprises a plurality of impact absorbing pads that are spaced apart on the inner surface of the shell and that conform to the inner concave curvatures at the various portions of the shell. The padding system comprises a front pad 32 that is removably attached at the front portion 14 of the shell, a crown pad 34 that is removably attached at the crown portion 16 of the shell, a pair of side pads 36 removably attached at the respective side portions 18 of the shell, and a back pad 38 removably attached at the back portion 20 of the shell.

As shown in FIG. 1, the padding system also includes a pair of jaw pads 70 connected to the inner surface of the side portions 18 of shell 12 by snaps and as disclosed in published U.S. patent application US 2011/0131695. Published patent application US 2011/0131695 is incorporated herein by reference for its teaching of protective jaw pads for a helmet shell.

Figure 7:
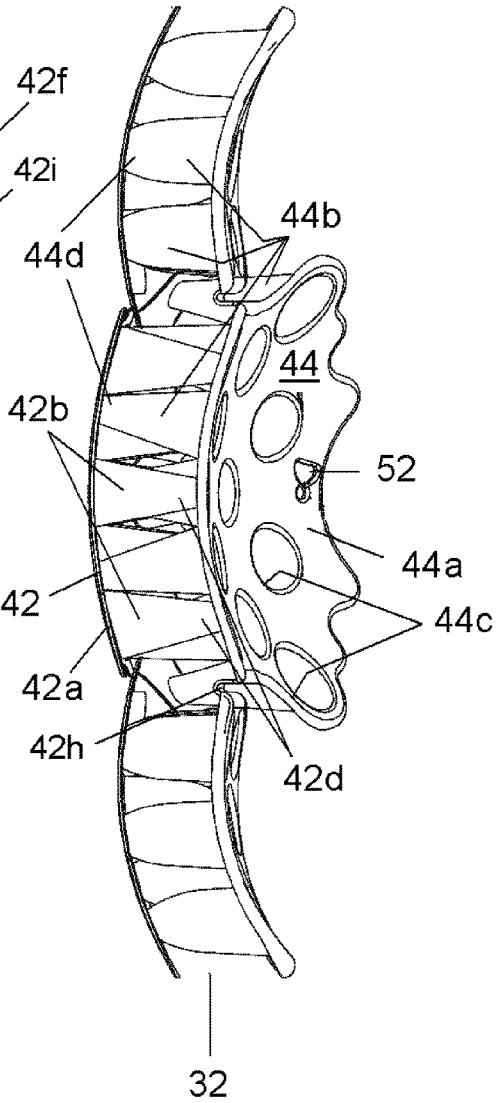
FIG. 7 is a bottom edge view of the front pad.
Figure 9:
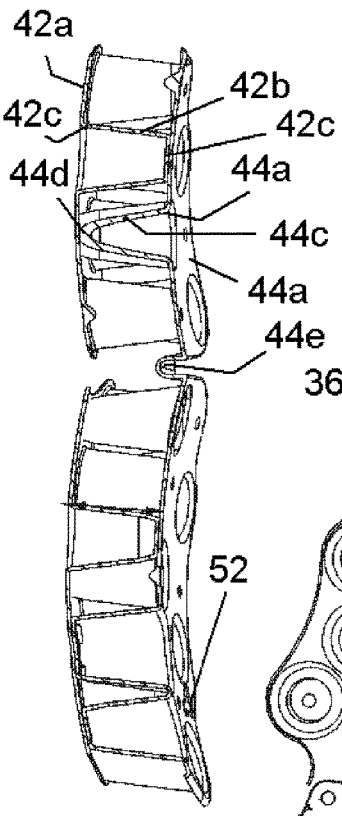
FIG. 9 is a side sectional view of the back pad taken along line 9-9 of FIG. 8.
Figure 8:
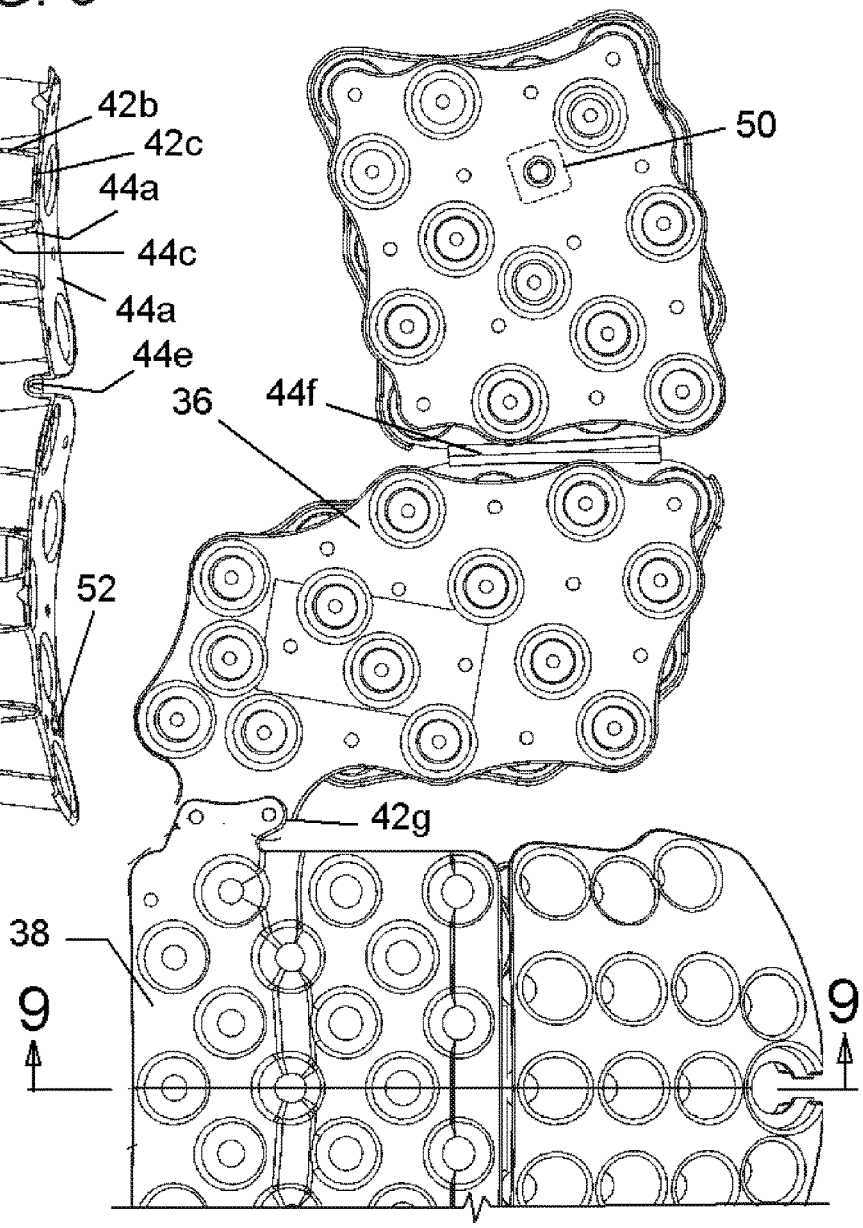
FIG. 8 is a partial plan view of the outer surfaces of a back and one side pad of the padding system.

As best shown in FIGS. 7 and 9, each pad has at least one portion made of two parts of molded thermoplastic urethane (TPU) that are bonded together and that comprise an outer part 42 made of thermoplastic urethane of a first durometer and comprising an outer sheet 42*a* having the selected curvature of the rigid shell adjacent the portion of the inner surface at which the pad is removably attached, and an inner part 44 made of thermoplastic urethane of a second durometer that is the same as the first durometer of the front pad 32, but that is harder than the first durometer of the outer pad, for the crown pad 34, back pad 38 and side pads 36. For all the pads and as also explained in U.S. Pat. No. 8,069,498, the inner part 44 comprises an inner sheet 44*a* that is substantially parallel to and spaced inwardly from the outer sheet 42*a* to define a space between the inner and outer sheets that is open around a perimeter of the inner and outer sheets for each pad. Each of the inner and outer sheets 44*a*, 42*a*, have a plurality of spaced apart, hollow protrusions 44*b* and 42*b* extending to the other sheet, the protrusions of one sheet alternating with the protrusions of the other sheet to form an impact absorbing pattern of alternating protrusions in the space between the sheets.

Each protrusion 42*b*, 44*b* has an open, larger diameter base 42*c* and 44*c* at the sheet from which it extends, a smaller diameter peak 42*d* and 44*d*, and a side wall that tapers from the base to the peak for each protrusion, each base, side wall and peak being molded of one piece of TPU with the sheet from which they extend, and each peak being fused, as best shown in FIG. 9, to the sheet of the other part of the pad. Upon an impact on the outer surface of the rigid shell 12 and a resulting relative movement of the helmet with respect to the head of the wearer, the small diameter peaks of the outer part of the pads in the crown, back and side areas of the impact, having the first lower durometer peaks nearer the wearer's head, collapse more easily than the peaks of the inner part of the pad nearer the shell and nearer the area of impact, to dissipate the impact with reduced pressure on the head of the wearer.

The first durometer of the various outer TPU parts of the various pads is between about 80 and 95 Shore-A and the second durometer of the various inner TPU parts is between about 90 and 95 Shore-A. For the back (38), both sides (36) and crown (34) pads, the inner parts have a second durometer that is from between about 5 to 10 Shore-A harder than the first durometer of the outer parts so that the small peaks of the outer part protrusions are softer toward the wears's head. For the central and both side portions 32*a* of the front pad 32, both the first and second durometer are about equal at about 95 Shore A for maximum protection at this front area of the helmet were impacts are most often expected to occur. This harder frontal durometer value is also reflected in the harder foam used in the comfort liner assembly at this location as will be explained later. The side portions 32*a* of the front pad 32 are connected to the central portion thereof by flexible extension 42*h* of the inner sheets 42 thereof, as shown in FIG. 7.

The first durometer of the outer part of the back pad 38 is advantageously about 80 Shore A with the second durometer of the inner part thereof being about 85 Shore A. Back pad 38 has bottom and top portions that are connected to each other by a flexible extension 44*e* of their inner sheets 44*a* shown in FIG. 9. The back pad 38 is also connected to each of the side pads 36 by fused together extensions 42*g* of the outer sheets 42*a* of each of these pads and each side pad 36 has rear and front portions connect to each other by a flexible extension 44*f* of the inner sheet 44*a* of these pads. For both portions of the side pads 36, the first durometer of the outer part is about 80 Shore A and the second durometer of the inner part is about 85 Shore A.

The first durometer of the outer part of the crown pad 34 is advantageously about 85 Shore A with the second durometer of the inner part thereof being about 90 Shore A. Here, as with the back and side pads, the softer outer protrusions are used but, for better protection, overall harder padding is used at the crown then at the back and sides. The overall crown pad harness is also less than the front pads, again to optimize impact protection where and as it is needed.

Figure 10:
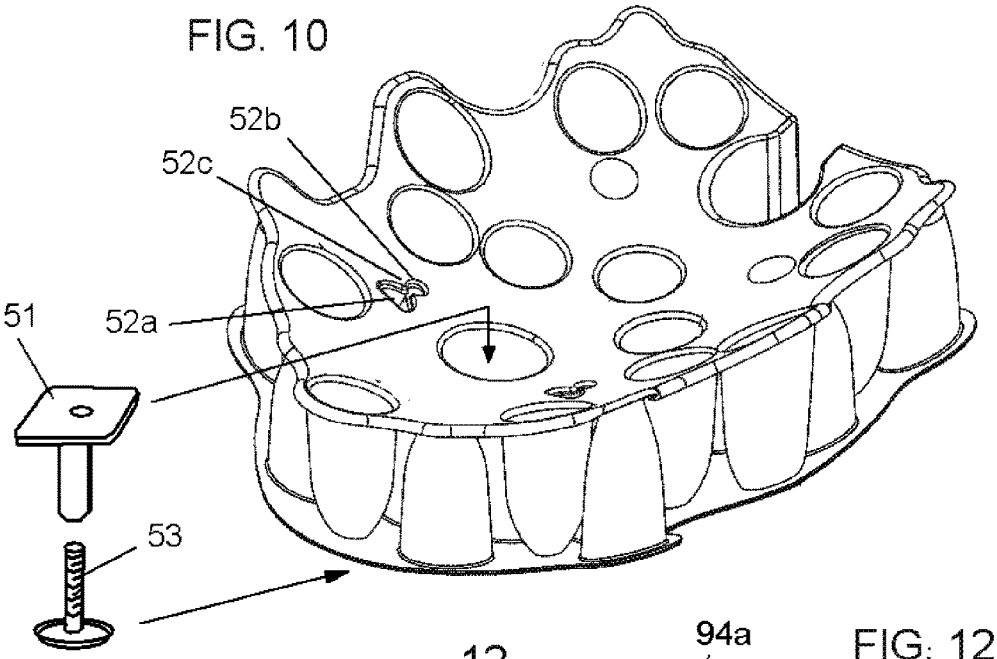
FIG. 10 is an inner front perspective view of a crown pad of the padding system.
Figure 11:
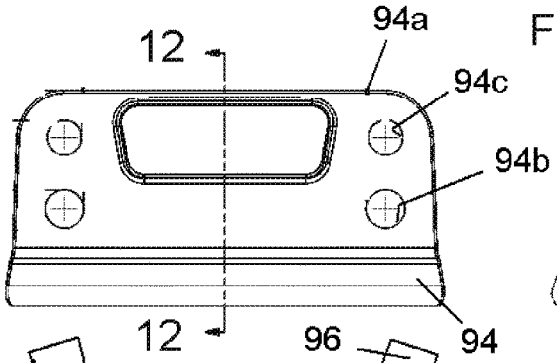
FIG. 11 front elevational view of a nameplate holder of a front or nose bumper of the helmet.
Figure 12:
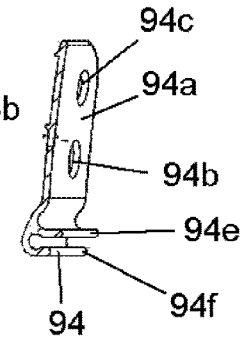
FIG. 12 is a sectional view taken along line 12-12 of FIG. 11.
Figure 13:
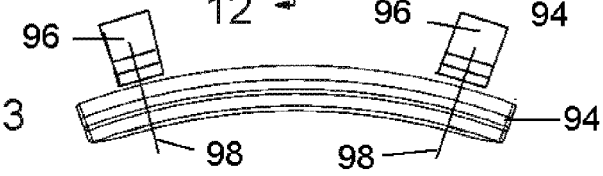
FIG. 13 is a top plan view of the nameplate holder plus loopstraps to be used with the nameplate holder for connecting a faceguard to the helmet shell.
Figure 16:
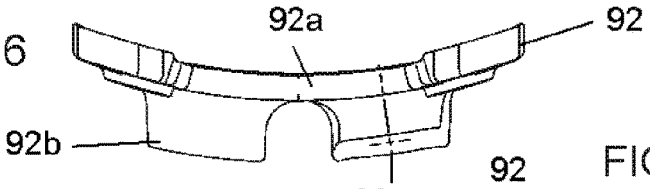
FIG. 16 is a top plan view of the quick release retainer.
Figure 14:
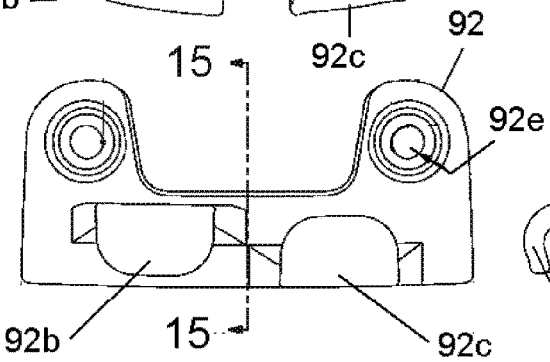
FIG. 14 is a front elevational view of a quick release, twist-off retainer of the nose bumper of the helmet.

According to the invention and contrary to current practice in the assembly of football helmets, at least some of the pads of the padding system are removably attached to the inside surface of shell by mechanical fasteners 50 extending through the shell 12, such as T-nuts shown for example in FIG. 10, having flange nut 51 with a threaded tube for engaging a hole in the pad and for extending through a hole in the shell, and a treaded screw 53, treaded to the threaded tube and extending from an outer surface of the shell. The head of a screw 53 for connecting the crown pad 34 is visible at the top of the helmet shell in FIG. 1. Another screw 53 extending in a snap fastener 7 for removably connecting a chin guard strap to the shell is also visible in FIG. 1 and is for a T-nut 50 that connects one of the side pads 36 to the shell. In this way the same hole that is needed to the chin strap snap 74 is also used for the T-nut for the pad mounting.

Figure 6:
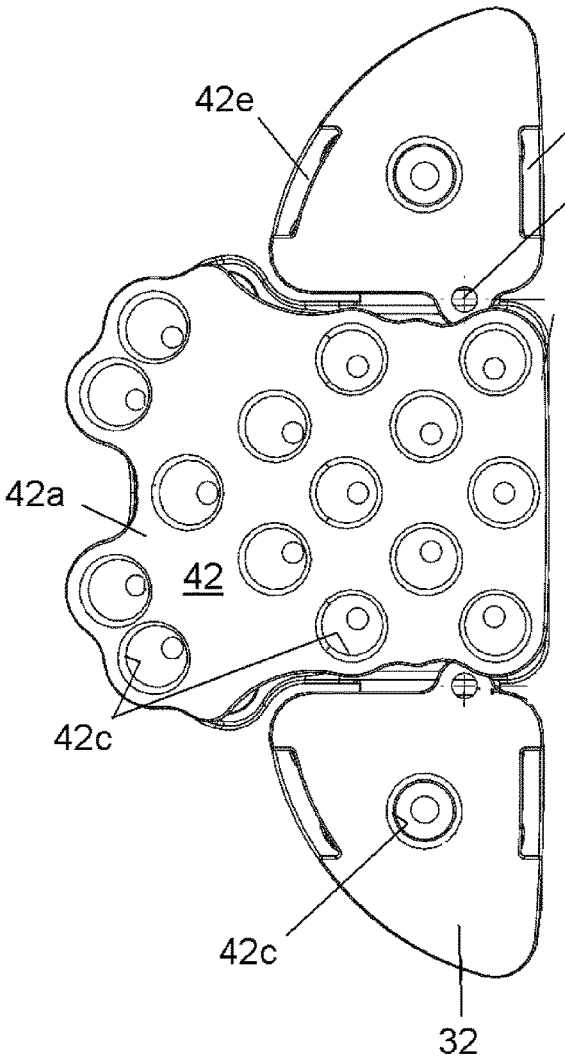
FIG. 6 is a plan view of the outer surfaces of a front pad of the padding system.

A further pair of screws 53 at the front portion 14 of the shell 12 under the upper parts of a faceguard 80 as seen in FIG. 1, are threaded to flange nuts 51 extending through holes 42*i* in the outer sheets 42*a* of the side portions 32*a* of the front pad 32 as shown in FIG. 6, for removably connecting the front pad into the front portion of the helmet shell.

At least some of the pads have inner sheet 44*a* with one or more keyholes 52 therein, each keyhole, as best shown in FIG. 10, having a large diameter, semicircular portion 52*a*, a small diameter circular portion 52*b* communicating with the large diameter portion, and a curved, hour-glass shaped constricted passage 52*c* between the large and small diameter portions that is smaller than the small diameter portion so that the keyhole is generally bell shaped. These keyholes 52 are for removably receiving resilient buttons and stems on the outer surfaces of the liners as will be explained later, for removably connecting the liners to the padding system in an improved manner.

As with the use of mechanical fasteners to removably connect the padding system to the helmet shell, the use of keyholes and buttons facilitates the removable connection of the liners to the padding system without the use of hook-and-loop fasteners that cannot be placed with great precision nor can they be engaged with great precision. These improved mounting arrangements improve the initial assembly and all later reconditioning of the helmet over what has been the norm in this field.

Referring now to FIGS. 2, 5 and 17-23, the helmet includes a comfort liner assembly that is removably attached to inner surfaces of the inner sheets of the pads of the padding system. The comfort liner assembly comprises a front liner 62 at an inner surface of the front pad 32, a crown liner 64 at an inner surface of crown pad 34, and a lateral liner comprising a pair of side cushion assemblies 66 at inner surfaces of the respective pair of side pads 36, and a back cushion assembly 68 at an inner surface of the a back pad 38.

Figure 4:
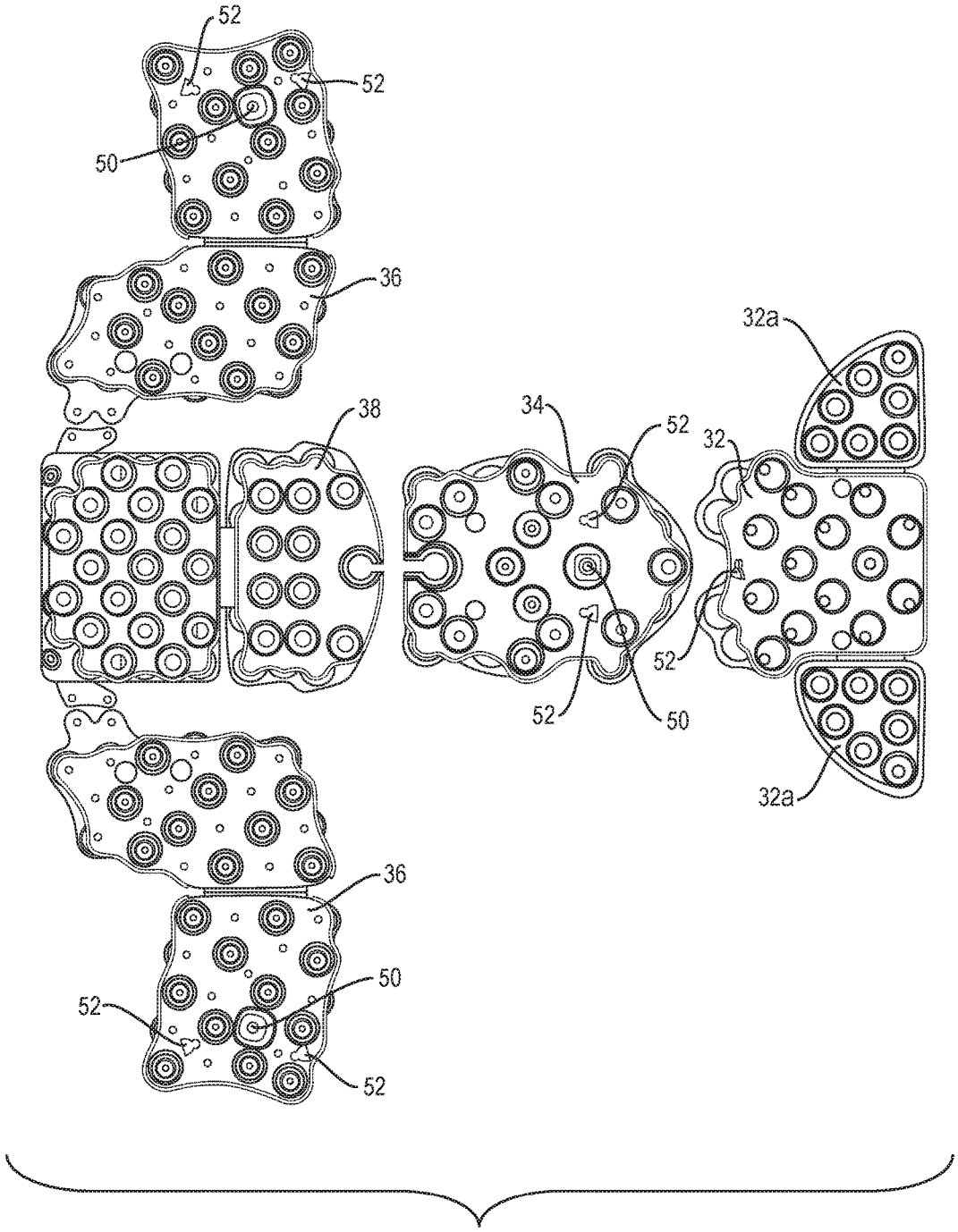
FIG. 4 is a plan view of the padding system laid out and with the inner surfaces showing for easier understanding.

The liners that are over at least some of the pads have one or more resilient buttons 54 each with a resilient stem 56, formed with or fused to an outer plastic sheet of the liners, for engaging each respective keyhole 52, each button having a diameter for being received in a respective large diameter portion 52*a* of a keyhole and each stem having a diameter that is larger than the constricted passage 52*c* and of a size for being received in a respective small diameter portion 52*b* of a respective keyhole 52, so that each button is removably trapped at a respective keyhole. A shown, in FIG. 18, front liner 62 has one button 54, in FIG. 20 crown liner 64 is shown to have two buttons 54 and as shown in FIG. 21, lateral liner 66, 68 has four buttons 54. Corresponding keyholes 52 or in the front, crown, and side pads as shown in FIG. 4.

Figure 18:
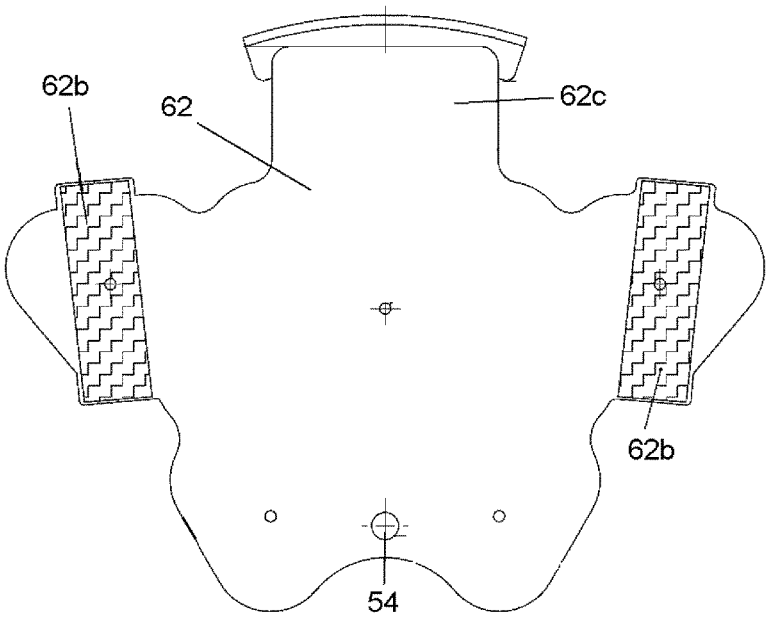
FIG. 18 is an outer surface view of the front liner.
Figure 19:
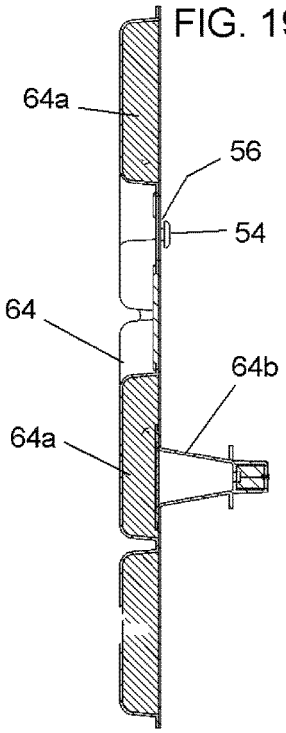
FIG. 19 is a sectional view of a crown liner of the comfort liner assembly.
Figure 20:
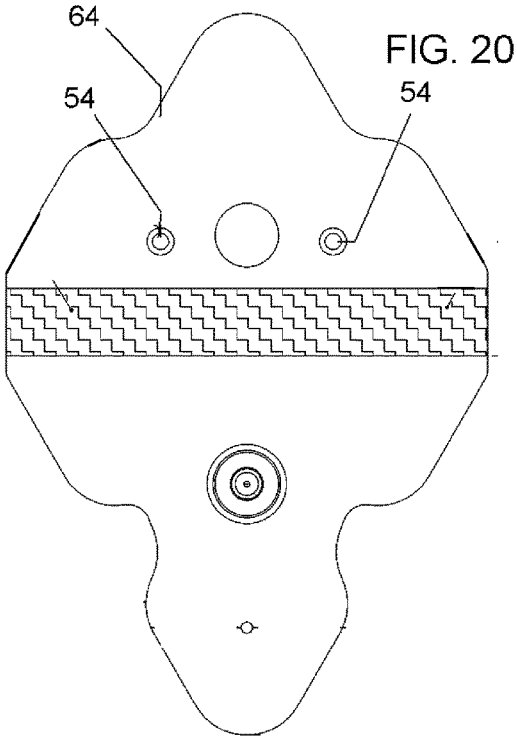
FIG. 20 is an outer surface view of the crown liner.

To help further connected the front liner 62 to and over the front pad 32, and as shown in FIG. 18, a pair of elastic strapping or bands 62*b* are fixed at opposite sides to the front liner 62 and engage around the side parts 32*a* of the front pad 32 for removable connecting the front liner to the front pad, the outer sheets 42*a* of the sides parts 32*a* of the front pad 32, as shown in FIG. 6, each having a pair of opposite notches 42*e* and 42*f* for trapping the elastic band to keep the front liner firming held to and centered on the front pad 32.

Figure 5:
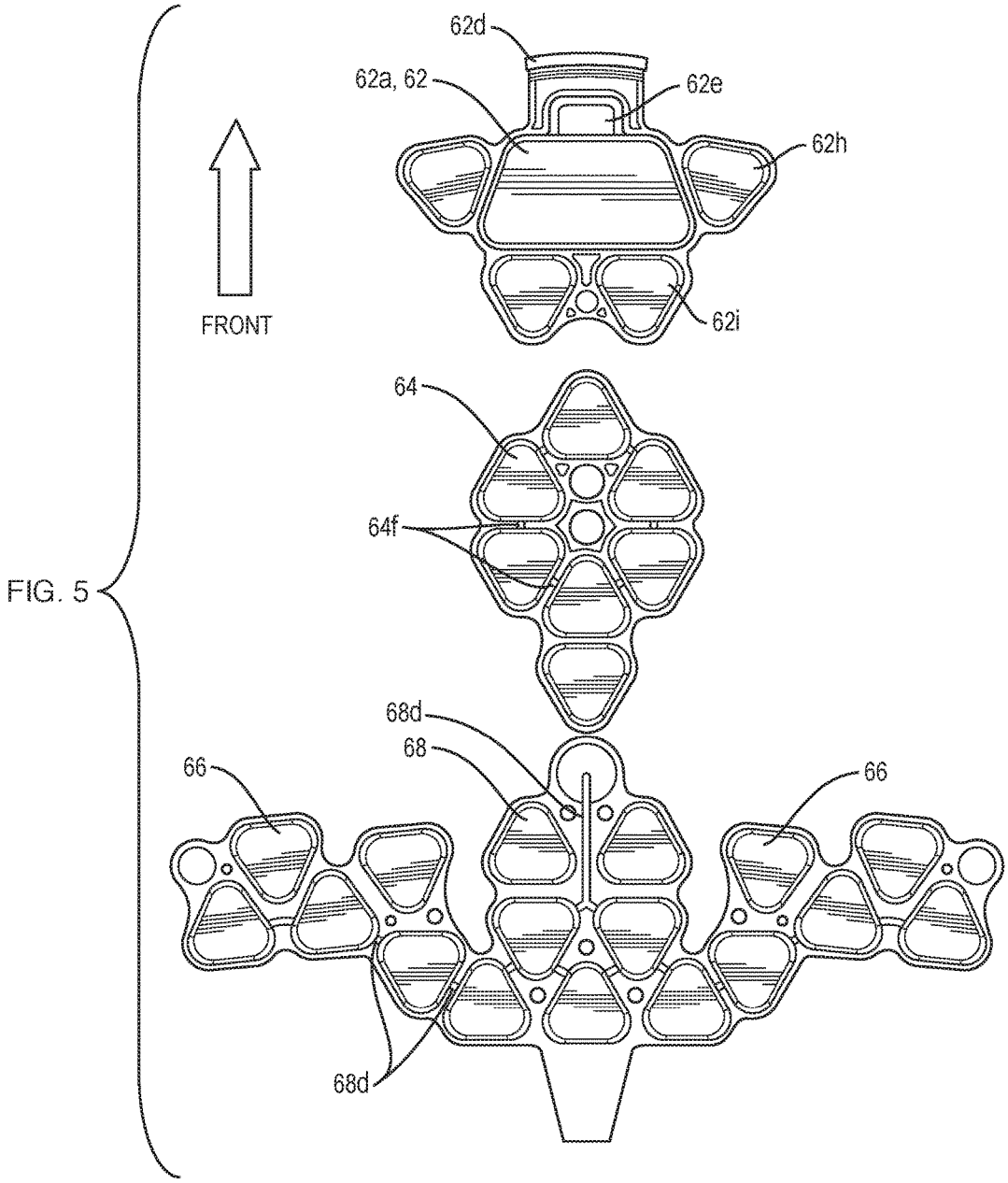
FIG. 5 is a plan view of the comfort liner assembly laid out and with the inner surfaces showing for easier understanding.

Each of the liners comprises inner and outer plastic sheets 68*a*, 68*b* make of thin (e.g. 0.02 to 0.04 inches) TPU sheets (see FIGS. 17 and 22) that are sealed to each other around their perimeter and elsewhere to form a plurality of pockets containing a plurality of triangular foam members as shown in FIG. 5 and at 68*c* in FIG. 22. The front liner 62 also comprises a quadrangular foam member 62*a* in FIG. 17. The crown liner 64 comprises six triangular foam members 64*a* around a center of the liner and a further triangular member at the back. The pair of side cushion assemblies 66 each comprise five staggered triangular foam members, and the back cushion assembly 68 comprises seven more triangular foam members all, spaced about the back and sides of the padding system for providing comfortable support for the wearer's head.

The back cushion assembly 68 (FIG. 21) also includes an extension of the inner and outer plastic sheets forming a ribbon connector 67 having a bead 69 near its end. The helmet includes a back bumper 72 for receiving and holding the bead, the back bumper 72 having a slot so as to be removably engaged over a lower central edge of the back portion 20 of the shell as also shown in FIG. 23, for holding the back cushion assembly 68 against the back pad 38.

The front liner 62 as shown in FIG. 5, has the one quadrangular foam member 62*a* at its center and a pair of triangular members 62*h* at either side as well as a further pair of triangular members 62*i* above the quadrangular foam member 62*a*. The foam members 62*a* and 62*h* that are positioned to engage the forehead of the wearer, are made of a harder foam then the other foam members 62*i* of front liner 62 and of all other the foam members of the crown and the lateral liners 64 and 66, 68. In the preferred embodiment of the invention this harder foam is PORON® brand microcellular urethane sold by Rogers Corporation and having a harness between about 15 and 21 Shore "O" durometer or preferably 18 Shore "O" durometer. The other softer triangular foam members of the front, crown and the lateral liners are made of polyether polyurethane with 25% compression of 2 psi and Shore "O" durometer of 3 to 10 less than the PORON® brand microcellular urethane.

The liners also comprise at least one relatively thin foam member 62*e* between the inner and outer plastic sheets 62*f*, 62*g* and under the relatively thick members 62*a* in some of the pockets that is make of the softer foam.

The football helmet as shown in FIGS. 1 and 2, also includes a faceguard 80 comprising cage of polymer coated metal bars having a pair of side bar parts 82 connected by side loopstrap connectors 100 to respective side portions 18 of the shell, and an upper portion 84 having a center bar part 86 connected by a nose bumper 90 to the front portion 14 of the shell, the upper portion of the faceguard including a pair of side bar parts 88 that are each bent upwardly with respect to the center bar part 86 by at least a multiple of a diameter of the center bar part, for example, a multiple of the ¼ inch diameter of the bars, for example by about 1 inch or by about ½ to to 1½ inches above the center bar part 86. The side bar parts then extend or are bent downwardly, toward each respective side bar part 82, to create a raised eyebrow area on either side of the front portion 14 of the rigid shell 12, to even better dissipate impacts at the front portion of the shell.

Each side connector 100 comprised a loopstrap connector engaging around a respective one of the side bar parts 82 and a mechanical fastener 102 for removably connecting the loop connector to the side portion of the shell, such as a T-nut or the partial turn connector of published U.S. patent application US 2011/0214224.

Figure 15:
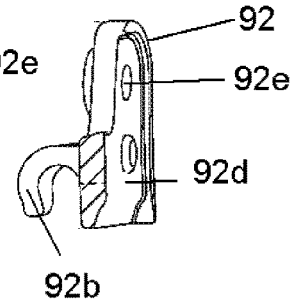
FIG. 15 is a sectional view taken along line 15-15 of FIG. 14.
Figure 17:
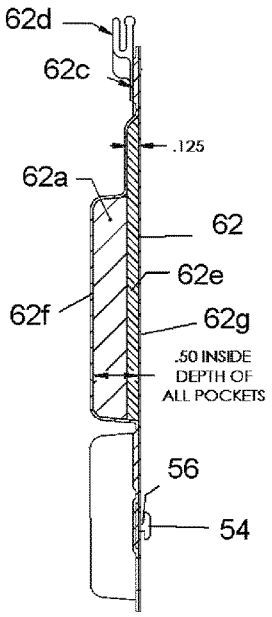
FIG. 17 is a sectional view of a front liner of the comfort liner assembly.

With reference to FIGS. 11-16, the nose bumper 90 includes a quick release retainer 92 having a base 92*a* and a pair of spaced retention arms 92*b* and 92*c* operating as disclosed in U.S. Pat. No. 8,146,178 for engaging above and below the center bar part 86 to hold the center bar part to the shell. The base 92*a* has a rear recess 92*d* as shown in FIG. 15. A nameplate holder 94 of FIGS. 11-13 has a base 94*a* fitting in the recess 92*d* and a pair of openings 94*b* for receiving fasteners for loop connectors 96 for replacing the quick release retainer 92 for holding the center bar part 86 to the shell, e.g. when an eye shield is to be attached to the faceguard 80. To this end the two screws that hold the nose bumper 90 to the shell and that are visible in FIG. 1. are removed and the quick release retainer 92 is removed. This leaves the nameplate holder 94 that is retained at the front portion 14 of the helmet shell by the two screws in two of its holes, and has two more holes or can use the same two holes and to connect loopstraps 96 to the shell for holding the upper center bar part 86 of faceguard 80 to shell 12.

The front liner 62 of the comfort liner assembly also cooperates with the nose bumper 90 to hold the front liner against the front pad 32 of the padding system. To this end the front liner 62 includes an extension of the inner and outer plastic sheets forming a ribbon connector 62*c* in FIGS. 17 and 18 having a fork 62*d* near its end, the nameplate holder 94 having base hook engagement portions 94*e* and 94*f* for removably connecting to the fork 62*d* of the front liner for holding the front liner over the front pad 32.

The sealed plastic sheets 62*f*, 62*g* for creating the pockets of the crown and lateral liners 64, 66, 68, can be inflated with air via inflating fittings 64*b* and 68*e* connected to the outer sheets of the crown liner 64 and the lateral liner 66, 68 for adding air into at least some of the pockets of the crown and lateral liners for creating a closer fit for the comfort liner assembly and the wearer's head. To this end and as shown in FIG. 5, the inner and outer sheets of plastic are sealed around and between the pockets as well, except in the areas of air channels 64*f* and 68*d* in the crown and lateral liners there air can be channeled from the pocket that is directly connected to the fittings 64*b* and 68*e*, to at least some of the other pockets in each of these liners.

The inflating fittings 64*b* and 68*e* extend in circular recesses in the upper edge of the back pad 38 and in the back edge of the crown pad 34 seen in FIG. 4, and are held by hoop-and-loop rings to the inner surface of the helmet shell. Two holes through the shell, to the rear of the upper screw 53 in FIG. 1 for holding the crown pad to the shell, permit a inflating pin to have access to the inflating fittings for inflating the crown and later liners after the wearer have put the helmet one, for a close and comfortable custom fitting of the helmet to the wearer's head.

While a specific embodiment of the invention has been shown and described in detail to illustrate the application of the principles of the invention, it will be understood that the invention may be embodied otherwise without departing from such principles. It will also be understood that the present invention includes any combination of the features and elements disclosed herein and any combination of equivalent features. The exemplary embodiments shown herein are presented for the purposes of illustration only and are not meant to limit the scope of the invention. Thus, all the features of all the embodiments disclosed herein are interchangeable so that any element of any embodiment may be applied to any of the embodiments taught herein.

What is claimed is:

1. A football helmet comprising:

a rigid plastic shell adapted to cover the head of a wearer, the rigid plastic shell having a front portion defining a face opening, the front portion having a lower edge;

a faceguard removably attached to the shell;

the faceguard including an upper portion, the upper portion including an uppermost bar having a center bar part and a pair of side bar parts, and a horizontal bar below the center bar part and connected to the center bar part by a vertical bar, the uppermost bar and horizontal bar defining a gap between them which extends the entire length of the horizontal bar;

the faceguard having a pair of raised eyebrow areas in the uppermost bar, the eyebrow areas being positioned on either side of the front portion of the shell and above the lower edge of the front portion of the shell;

each raised eyebrow area consisting of one of the pair of side bar parts bent upwardly with respect to the center bar part.

2. The football helmet of claim 1 wherein each raised eyebrow area is above the center bar part by at least a multiple of ¼ inch.

3. The football helmet of claim 1 wherein each raised eyebrow area is above the center bar part by at least a multiple of a diameter of the center bar part.

4. The football helmet of claim 1 further comprising a nose bumper attached to the shell, the nose bumper including a quick-release retainer comprising a base, a first retention arm attached to the base, and a second retention arm attached to the base and spaced apart from the first retention arm, the first retention arm and second retention arm engaging the center bar part.

5. The football helmet of claim 4 wherein the first retention arm engages above the center bar part and the second retention arm engages below the center bar part, such that the center bar part is received into a space between the first retention arm and the second retention arm, such that the faceguard can be twisted into place.

6. A face guard for a football helmet comprising:

a cage of bars including an upper portion, the upper portion including an uppermost bar having a center bar part and a pair of side bar parts, and a horizontal bar below the center bar part and connected to the center bar part by a vertical bar, the uppermost bar and horizontal bar defining a gap between them which extends an entire length of the horizontal bar so that the uppermost bar does not contact horizontal bar at any point along the entire length;

the faceguard having a pair of raised eyebrow areas in the uppermost bar, each raised eyebrow area consisting of one of the pair of side bar parts bent upwardly with respect to the center bar part.

7. The football helmet of claim 6 wherein each raised eyebrow area is above the center bar part by at least a multiple of ¼ inch.

8. The football helmet of claim 6 wherein each raised eyebrow area is above the center bar part by at least a multiple of a diameter of the center bar part.

9. A face guard for a football helmet comprising:

a cage of polymer-coated bars including an upper portion, the upper portion including an uppermost bar having a center bar part and a pair of side bar parts, and a horizontal bar below the center bar part and connected to the center bar part by a vertical bar, the uppermost bar not contacting the horizontal bar at any point along the length of the horizontal bar;

the faceguard having a pair of raised eyebrow areas in the uppermost bar, each raised eyebrow area consisting of one of the pair of side bar parts bent upwardly with respect to the center bar part.

10. The face guard of claim 9 wherein each raised eyebrow area is above the center bar part by at least a multiple of ¼ inch.

11. The face guard of claim 9 wherein each raised eyebrow area is above the center bar part by at least a multiple of a diameter of the center bar part.

12. The football helmet of claim 4 wherein the nose bumper is between the pair of raised eyebrow areas.

* * * * *